US005814758A

United States Patent [19]

Leidel

[11] Patent Number: 5,814,758

[45] Date of Patent: Sep. 29, 1998

[54] APPARATUS FOR DISCHARGING A HIGH SPEED JET TO PENETRATE A TARGET

[75] Inventor: David J. Leidel, Arlington, Tex.

[73] Assignee: Halliburton Energy Services, Inc., Dallas, Tex.

[21] Appl. No.: 802,834

[22] Filed: Feb. 19, 1997

[51] Int. Cl.[6] ..... F42B 3/08; F42B 12/10

[52] U.S. Cl. ..... 102/307; 102/378; 102/476; 175/4.6

[58] Field of Search ..... 102/306–310, 102/476, 378; 175/4.6

[56] References Cited

U.S. PATENT DOCUMENTS

| | | | |
|---|---|---|---|
| Re. 31,420 | 10/1983 | Christopher | 428/546 |
| 2,605,703 | 8/1952 | Lawson | 102/306 |
| 3,165,057 | 1/1965 | Armstrong | 102/307 |
| 3,248,072 | 4/1966 | Schimmel | 102/307 |
| 4,338,713 | 7/1982 | Christophy | 102/306 |
| 4,557,771 | 12/1985 | Bencz et al. | 102/476 |
| 4,613,370 | 9/1986 | Held et al. | 102/306 |
| 4,628,819 | 12/1986 | Backofen, Jr. et al. | 102/307 |
| 4,693,181 | 9/1987 | Dadley et al. | 102/307 |
| 5,221,808 | 6/1993 | Werner et al. | 102/307 |
| 5,501,154 | 3/1996 | Rodney et al. | 102/307 |
| 5,567,906 | 10/1996 | Reese et al. | 102/307 |
| 5,656,791 | 8/1997 | Reese et al. | 102/307 |

*Primary Examiner*—Harold J. Tudor
*Attorney, Agent, or Firm*—William M. Imwalle; Paul I. Herman; Lawrence R. Youst

[57] ABSTRACT

A flexible linear shaped charge for discharging a high speed jet to penetrate a target comprising an outer housing which includes a sheath and the high speed jet, the high speed jet being integral with the sheath, and an explosive core disposed within the outer housing between the sheath and the high speed jet, the outer housing comprising a low density matrix mixed with a high density heavy metal powder to increase the confinement of the explosive core, thereby improving the performance of the shaped charge.

5 Claims, 2 Drawing Sheets

APPARATUS FOR DISCHARGING A HIGH SPEED JET TO PENETRATE A TARGET

TECHNICAL FIELD OF THE INVENTION

This invention relates in general to an apparatus for discharging a high speed jet to penetrate a target and, in particular to, a shaped charge having an outer housing comprising a low density matrix mixed with a high density heavy metal powder to increase the confinement of an explosive core and to improve the performance of the shaped charge.

BACKGROUND OF THE INVENTION

Without limiting the scope of the invention, its background is described in connection with penetrating the housing of a bomb casing using a linear shaped charge, as an example.

Heretofore, in this field, shaped charges have been utilized in a variety of industries wherein it is necessary to penetrate a target with a high speed jet. For example, it has been found that linear shaped charges are suitable for the purpose of opening up bomb casings during explosive ordinance disposal. Typically, this process is achieved by wrapping the linear shaped charge around the bomb casing at the location of the desired cut. In order to wrap around a bomb casing, however, the outer housing of the linear shaped charge must be constructed out of a highly flexible material. In prior years, the material selected for the outer housing of the linear shaped charge was lead.

During the detonation of a linear shaped charge, a portion of the outer housing becomes a high speed jet which penetrates the metal housing of the bomb casing. The remainder of the housing, however, is fragmented into a plurality of metal strips which are not suitable for reuse. Thus, in the past, detonating linear shaped charges to penetrate bomb casings created a need for disposal of lead fragments.

To overcome the problems associated with the disposal of the lead fragments, including the environmental impact of lead disposal, attempts have been made to substitute other flexible materials for lead. Materials such as pewter have been used in place of lead to construct the outer housing of linear shaped charges due to the flexibility of pewter. It has been found, however, that the performance of linear shaped charges having a pewter outer housing is substantially less than that of a linear shaped charge having a lead outer housing. Specifically, there has been a substantial decrease in the penetration of the high speed jet generated from a linear shaped charge having a pewter outer housing.

Two factors contribute to the reduced performance of linear shaped charges having outer housing made of pewter. First, the mass of the high speed jet is reduced due to the lower density of pewter as compared with lead. Second, the confinement of the explosive core of the linear shaped charge is reduced also due to the lower density of pewter.

Therefore, a need has arisen for a linear shaped charge with an explosive core that is sufficiently confined and that can generate a high speed jet having sufficient mass to penetrate the outer housing of bomb casings which will not create a lead disposal problem after detonation.

SUMMARY OF THE INVENTION

The present invention disclosed herein comprises an apparatus for discharging a high speed jet to penetrate a target which provides for the substantial confinement of the explosive core and generates a high speed jet having sufficient mass to penetrate a target while avoiding the adverse environmental impact created by lead disposal.

The shaped charge of the present invention comprises an outer housing constructed from a low density matrix mixed with a high density heavy metal powder. The high density heavy metal powder may be selected from a group consisting of tungsten, hafnium, tantalum, copper and bismuth. The high density heavy metal powder is mixed with the low density matrix which may be selected from the group consisting of zinc, zinc alloys, tin, tin alloys, polymers or ceramics.

The amount of the high density metal powder by weight which is added to the low density matrix may be between about 10 and 75 percent of the total weight. Specifically, when the low density matrix is tin or a tin alloy and the high density heavy metal powder is tungsten, the weight percent of the high density heavy metal powder may be between about 35 and 75 percent and preferably about 56 percent. When the low density matrix is zinc or a zinc alloy and the high density heavy metal powder is tungsten, the weight percent of high density heavy metal powder may be between about 10 and 40 percent and preferably about 20 percent.

BRIEF DESCRIPTION OF THE DRAWINGS

For a more complete understanding of the present invention, including its features and advantages, reference is now made to the detailed description of the invention, taken in conjunction with the accompanying drawings of which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
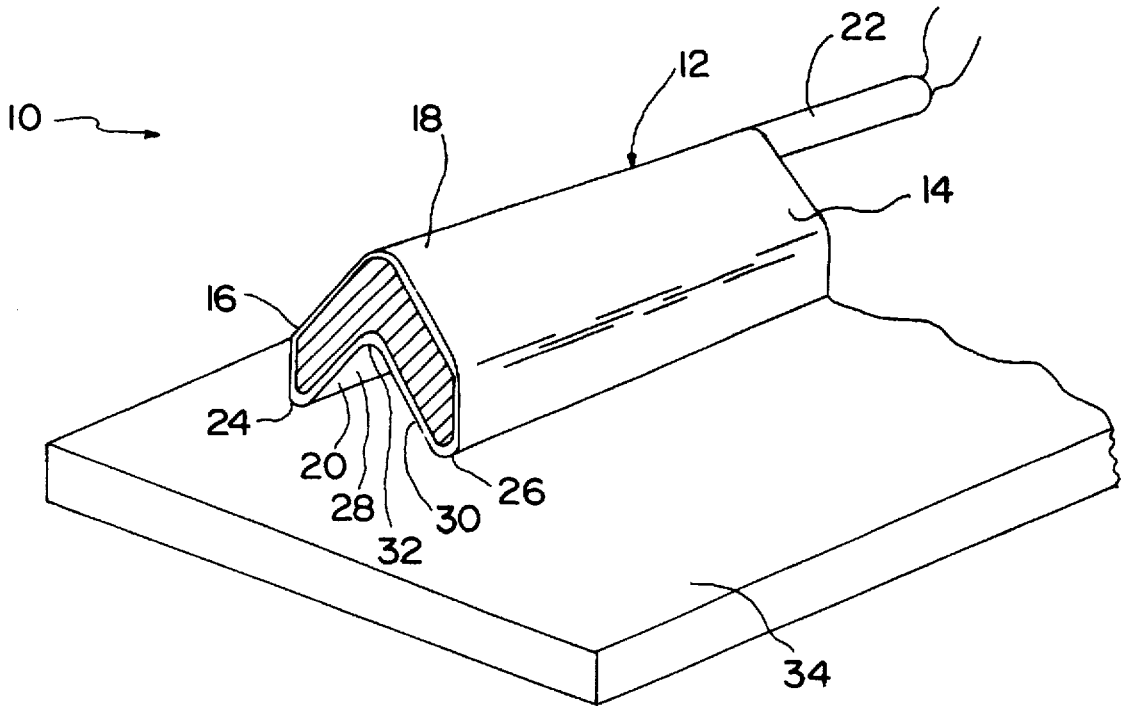
FIG. 1 is a perspective representation of a section of a linear shaped charge of the present invention positioned proximate a target.

In FIG. 1, a linear shaped charge positioned proximate a target is depicted and is generally designated 10. Linear shaped charge 12 includes outer housing 14 which wraps around and confines explosive core 16. Outer housing 14 includes an upper sheath 18 and a V-shaped element 20 which becomes a high speed jet upon detonation of explosive core 16. V-shaped element 20 separates from upper sheath 18 along junctures 24 and 26. During detonation, explosive core 16 deforms V-shaped element 20 into a two-dimensional planar member by folding first surface 28 and second surface 30 together along juncture 32. After this collapsing process, V-shaped element 20 is injected into target 34 creating a cut through target 34 as a high speed jet.

The performance of linear shaped charge 12 is determined by the depth of cut achievable through a specific target 34.

For example, linear shaped charge 12 may be used to cut through the steel housing of a bomb casing. The depth of cut achievable with linear shaped charge 12 is determined by the mass and the velocity of the high speed jet. The mass of the high speed jet of shaped charge 12 of the present invention is enhanced by adding a high density metal powder into the low density flexible metal matrix due to the increase in the density of the high speed jet.

The high density heavy metal powder which is added to the low density flexible metal matrix may be heavy metals such as tungsten, hafnium, tantalum, copper or bismuth. The low density flexible metal matrix may be zinc, a zinc alloy, tin, a tin alloy, a polymers or a ceramics. As an example, the amount of tungsten powder, by weight, which should be added to tin or a tin alloy matrix is between about 35 and 75 percent. More specifically, in order to achieve similar results as a linear shaped charge having a lead outer housing including a lead high speed jet, the amount of tungsten which should be added to the tin or tin alloy matrix is about 56 percent.

In addition to enhancing the mass of the high speed jet, adding the heavy metal powder to the low density flexible metal matrix improves the confinement of explosive core 16, thereby increasing the velocity of the high speed jet which, in turn, increases the depth of penetration achievable by linear shaped charge 12 into target 34. After detonation, upper sheath 18 of outer housing 14 disintegrates into a plurality of fragments which require disposal.

Figure 2:
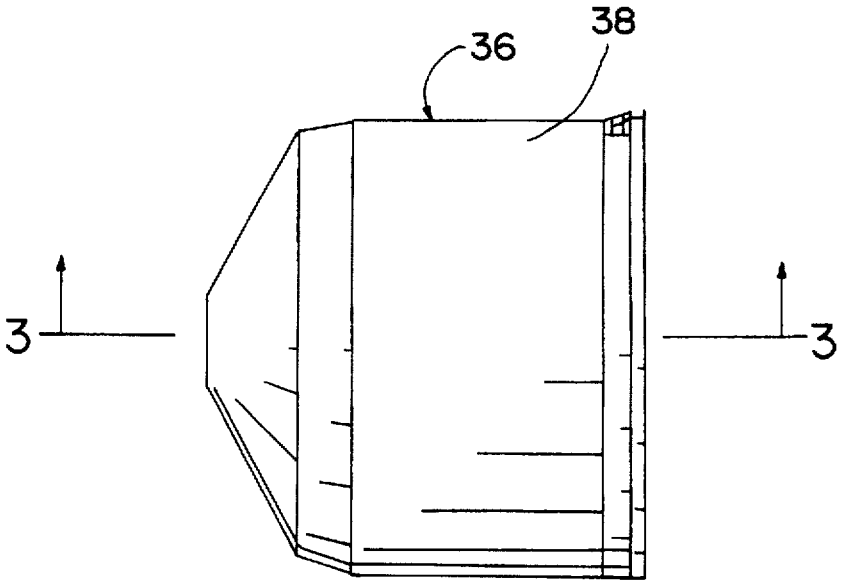
FIG. 2 is a side elevation view of a conically symmetrical shaped charge of the present invention which may be carried on an elongated perforating gun of the type generally used to perforate oil and gas wells.

Referring now to FIG. 2, a side elevation view of a conically symmetrical shaped charge 36 of the present invention is depicted. Conically symmetrical shaped charge 36 is of the type which may be carried on an elongated perforated gun which is generally used to perforate oil and gas wells. Conically symmetrical shaped charge 36 has an outer case 38 which is constructed by mixing a heavy metal powder with a low density matrix. The high density heavy metal powder which is mixed with the low density matrix may include, but is not limited to, tungsten, hafnium, tantalum, copper or bismuth. The low density matrix may be selected from a group consisting zinc, zinc alloys, tin, tin alloys, polymers or ceramics.

Figure 3:
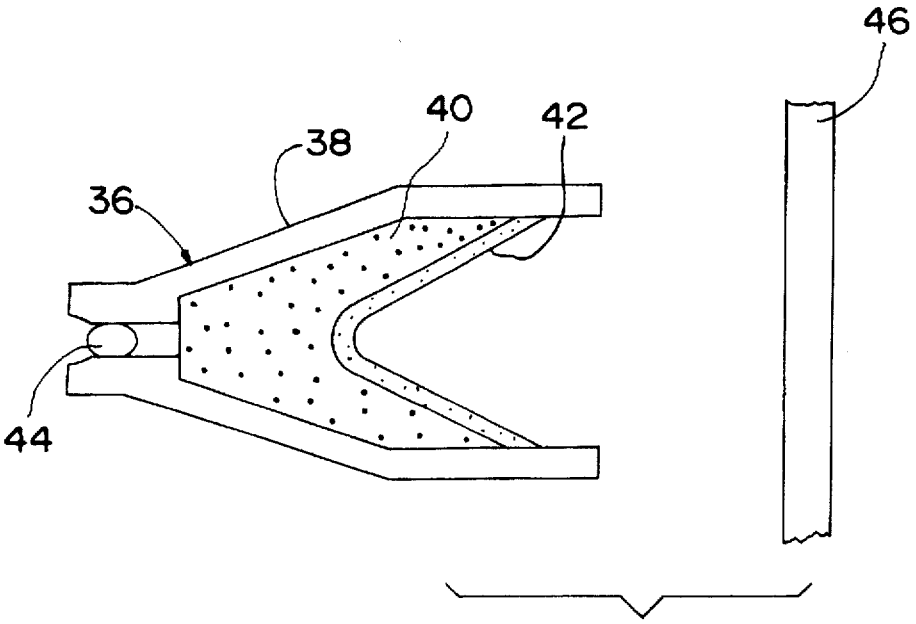
FIG. 3 is a cross-sectional view taken along line 3—3 of FIG. 2 of a conically symmetrical shaped charge of the present invention.

As best seen in FIG. 3, case 38 confines main explosive 40 which is disposed between case 38 and liner 42. In this embodiment, liner 42 becomes the high speed jet after conically symmetrical shaped charge 36 is detonated using detonating cord 44. After detonation, liner 42 is propelled from conically symmetrical shaped charge 36 into target 46, which may be the casing in an oil or gas well. The depth of penetration of liner 42 is determined by the mass of liner 42 and the velocity of liner 42. The velocity of liner 42 is increased due to the improved confinement of main explosive 40 within case 38 of the present invention. For example, using tungsten as the high density metal powder and mixing the tungsten with zinc or a zinc alloy, the amount of tungsten, by weight, should be between about 10 and 40 percent. Preferably, the amount of tungsten added to the zinc or zinc alloy matrix should be about 20 percent.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A flexible linear shaped charge for discharging a high speed jet to penetrate a target comprising:

an outer housing formed from a mixture of tungsten powder in a tin matrix; and an explosive core disposed within said outer housing.

2. The flexible linear shaped charge as recited in claim 1 wherein the amount of said tungsten powder added to said tin matrix by weight is between about 35 and 75 percent.

3. The flexible linear shaped charge as recited in claim 1 wherein the amount of tungsten powder added to said tin matrix by weight is about 56 percent.

4. A flexible linear shaped charge for discharging a high speed jet to penetrate a target comprising:

an outer housing formed from a mixture of a low density metal matrix selected from the group consisting of tin and tin alloys mixed with a high density heavy metal powder selected from a group consisting of hafnium, tantalum and bismuth, wherein the amount of said high density heavy metal powder added to said low density metal matrix by weight is between about 35 and 75 percent; and an explosive core disposed within said outer housing.

5. The flexible linear shaped charge as recited in claim 4 wherein the amount of said high density heavy metal powder added to said low density metal matrix by weight is about 56 percent.

* * * * *